US009214735B2

(12) United States Patent
Liu et al.

(10) Patent No.: US 9,214,735 B2
(45) **Date of Patent: *Dec. 15, 2015**

(54) IMPEDANCE MATCHING COMPONENT, METAMATERIAL PANEL, CONVERGING COMPONENT AND ANTENNA

(75) Inventors: Ruopeng Liu, Guangdong (CN); Chunlin Ji, Guangdong (CN); Yutao Yue, Guangdong (CN)

(73) Assignees: KUANG-CHI INNOVATIVE TECHNOLOGY LTD., FuTian District, Shenzhen, Guangdong (CN); KUANG-CHI INSTITUTE OF ADVANCED TECHNOLOGY, Nanshan District, Shenzhen, Guangdong (CN)

( * ) Notice: Subject to any disclaimer, the term of this patent is extended or adjusted under 35 U.S.C. 154(b) by 739 days.

This patent is subject to a terminal disclaimer.

(21) Appl. No.: 13/522,971

(22) PCT Filed: Nov. 28, 2011

(86) PCT No.: PCT/CN2011/083025

§ 371 (c)(1), (2), (4) Date: Jul. 19, 2012

(87) PCT Pub. No.: WO2012/171299

PCT Pub. Date: Dec. 20, 2012

(65) Prior Publication Data

US 2013/0002509 A1 Jan. 3, 2013

(30) Foreign Application Priority Data

Jun. 17, 2011 (CN) ..... 2011 1 0163718
Jun. 17, 2011 (CN) ..... 2011 1 0163805
Jul. 29, 2011 (CN) ..... 2011 1 0216663
Jul. 29, 2011 (CN) ..... 2011 1 0216702

(51) Int. Cl.
*H01Q 1/50* (2006.01)
*H01Q 15/00* (2006.01)

(52) U.S. Cl.
CPC ..... *H01Q 15/0086* (2013.01)

(58) Field of Classification Search
CPC ..... H01Q 15/02; H01Q 19/065
USPC ..... 343/753, 909, 757, 761, 782, 860; 375/338; 250/339.05, 482.1, 503.1; 359/642, 620, 321, 341.32, 586, 652
See application file for complete search history.

*Primary Examiner* — Sue A Purvis
*Assistant Examiner* — Jae Kim
(74) *Attorney, Agent, or Firm* — Winston Hsu; Scott Margo

(57) ABSTRACT

An impedance matching component is disclosed. The impedance matching component is disposed on and closely attached to a first side surface of a function dielectric sheet. The impedance matching component comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the impedance matching layers and is a positive integer; $n_i(r)$ represents refractive indices of points in the $i^{th}$ impedance matching layer that have a distance of r from a center of the $i^{th}$ impedance matching layer; $n_g(r)$ represents refractive indices of points in the function dielectric sheet that have a distance of r from a center of the function dielectric sheet; $n_{min}$ represents the minimum refractive index of the function dielectric sheet; and c represents the number of the impedance matching layers.

20 Claims, 12 Drawing Sheets

IMPEDANCE MATCHING COMPONENT, METAMATERIAL PANEL, CONVERGING COMPONENT AND ANTENNA

FIELD OF THE INVENTION

The present invention generally relates to impedance matching technologies, and more particularly, to an impedance matching component, a metamaterial panel, a converging component and an antenna.

BACKGROUND OF THE INVENTION

With continuous development of the science and technologies, the electromagnetic wave technologies have found wide application in various aspects of people's life gradually. An important property of electromagnetic waves is that they can propagate in any media or even in a vacuum. During propagation of an electromagnetic wave from a transmitting end to a receiving end, the energy loss has a direct influence on the propagation distance of the electromagnetic wave and on the signal transmission quality.

The electromagnetic wave suffers substantially no energy loss when propagating through a same medium. However, when the electromagnetic wave propagates through an interface between different media, partial reflection of the electromagnetic wave will occur. Usually, the larger the difference in electromagnetic parameters (e.g., the dielectric constant or the magnetic permeability) between the different media at two sides of the interface is, the more the reflection will be. Due to the partial reflection of the electromagnetic wave, the electromagnetic wave will suffer an electromagnetic energy loss in the propagation direction, which has a serious influence on the propagation distance of the electromagnetic wave and on the signal transmission quality.

To avoid reflection of the electromagnetic wave during propagation due to changes in refractive index and to reduce the reflection interferences and losses, usually impedance matching layers are disposed on a function dielectric sheet to reduce the reflection losses. Currently, the primary way to solve the problem of impedance matching during propagation of electromagnetic waves is to adopt an equal difference design, i.e., the refractive index distribution of the impedance matching layers satisfies the following formula:

$$n(i) = n_{min} + \frac{i \times (n_g(r) - n_{min})}{i+1},$$

where i is No. of an impedance matching layer, $n_g$ (r) is a refractive index distribution function of the function dielectric sheet, and $n_{min}$ is the minimum refractive index of the function dielectric sheet. Although the impedance matching layers satisfying the aforesaid formula can reduce the reflection interferences to some extent, the effect is not so significant. Therefore, an improved impedance matching technology is needed to reduce the reflection interferences and losses.

Further, in conventional optics, a lens can be used to refract a spherical wave radiated from a point light source located at a focus of the lens into a plane wave. Currently, the diverging effect of the lens is achieved by virtue of the refractive property of the spherical form of the lens. The inventor has found in the process of making this invention that, the lens has at least the following technical problems: the spherical lens is bulky and heavy, which is unfavorable for miniaturization; performances of the spherical lens rely heavily on the shape thereof, and directional propagation from the antenna can be achieved only when the lens has a precise shape; and serious interferences and losses are caused to the electromagnetic wave, which reduces the electromagnetic energy. Moreover, for most lenses, abrupt transitions of the refractive indices follow a simple line that is perpendicular to a lens surface. Consequently, electromagnetic waves propagating through the lenses suffer from considerable refraction, diffraction and reflection, which have a serious effect on the performances of the lenses.

SUMMARY OF THE INVENTION

In view of the defects of existing technologies that the reflection interferences and losses are significant, the present invention provides an impedance matching component, a metamaterial panel, a converging component and an antenna.

The technical solution provides an impedance matching component, which is disposed on and closely attached to a first side surface of a function dielectric sheet. The impedance matching component comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the first plurality of impedance matching layers and is a positive integer, and the serial number increases when it closes to the function dielectric sheet; $n_i(r)$ represents refractive indices of points in a $i^{th}$ impedance matching layer of the first plurality of impedance matching layers that have a distance of r from a center of the $i^{th}$ impedance matching layer; $n_g(r)$ represents refractive indices of points in the function dielectric sheet that has a distance of r from a center of the function dielectric sheet; $n_{min}$ represents a minimum refractive index of the function dielectric sheet; and c represents a number of the impedance matching layers.

According to a preferred embodiment of the present invention, the impedance matching component further comprises a second plurality of impedance matching layers closely attached to a second side surface of the function dielectric sheet and distributed symmetrically with the first plurality of impedance matching layers, and a refractive index distribution of each of the second plurality of impedance matching layers is identical to that of a corresponding one of the first plurality of impedance matching layers that is disposed symmetrically therewith.

According to a preferred embodiment of the present invention, the function dielectric sheet comprises a plurality of metamaterial sheet layers, each of which comprises a sheet-like substrate and a plurality of man-made microstructures attached on the substrate.

According to a preferred embodiment of the present invention, each of the first plurality of impedance matching layers comprises a sheet-like substrate and a plurality of man-made microstructures attached on the substrate.

According to a preferred embodiment of the present invention, each of the man-made microstructures is a two-dimensional (2D) or three-dimensional (3D) structure comprising at least one metal wire.

According to a preferred embodiment of the present invention, the function dielectric sheet is adapted to converge electromagnetic waves; the metamaterial sheet layers have an identical refractive index distribution to each other, each of the metamaterial sheet layers comprises a circular region and a plurality of annular regions concentric with the circular region, refractive indices of the circular region and the annular regions decrease continuously from $n_p$ to $n_0$ as a radius thereof increases, and points having a same radius have a same refractive index.

The technical solution further provides a metamaterial panel, which comprises a function dielectric sheet and an impedance matching component. The impedance matching component is disposed on and closely attached to a first side surface of the function dielectric sheet, and comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the first plurality of impedance matching layers and is a positive integer, and the serial number increases when it closes to the function dielectric sheet; $n_i(r)$ represents refractive indices of points in the $i^{th}$ impedance matching layer that have a distance of r from a center of the $i^{th}$ impedance matching layer; $n_g(r)$ represents refractive indices of points in the function dielectric sheet that have a distance of r from a center of the function dielectric sheet; $n_{min}$ represents a minimum refractive index of the function dielectric sheet; and c represents a number of the impedance matching layers.

According to a preferred embodiment of the present invention, the impedance matching component further comprises a second plurality of impedance matching layers closely attached to a second side surface of the function dielectric sheet and distributed symmetrically with the first plurality of impedance matching layers, and a refractive index distribution of each of the second plurality of impedance matching layers is identical to that of a corresponding one of the first plurality of impedance matching layers that is disposed symmetrically therewith.

According to a preferred embodiment of the present invention, the function dielectric sheet comprises a plurality of metamaterial sheet layers, each of which comprises a sheet-like substrate and a plurality of man-made microstructures attached on the substrate; and/or each of the first plurality of impedance matching layers comprises a sheet-like substrate and a plurality of man-made microstructures attached on the substrate.

The technical solution further provides an antenna, which comprises a radiating source and a metamaterial panel capable of converging electromagnetic waves emitted from the radiating source and adapted to convert the electromagnetic wave into a plane wave. The metamaterial panel comprises a function dielectric sheet and an impedance matching component, the impedance matching component is disposed on and closely attached to a first side surface of the function dielectric sheet, and comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the first plurality of impedance matching layers and is a positive integer, and the serial number increases when it closes to the function dielectric sheet; $n_i(r)$ represents refractive indices of points in a $i^{th}$ impedance matching layer of the first plurality of impedance matching layers that have a distance of r from a center of the $i^{th}$ impedance matching layer; $n_g(r)$ represents refractive indices of points in the function dielectric sheet that have a distance of r from a center of the function dielectric sheet; $n_{min}$ represents a minimum refractive index of the function dielectric sheet; and c represents a number of the impedance matching layers.

The technical solution further provides a converging component, which comprises a function dielectric sheet and an impedance matching component. The impedance matching component is disposed on and closely attached to a first side surface of the function dielectric sheet, and the impedance matching component comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the first plurality of impedance matching layers and is a positive integer, and the serial number increases when it closes to the function dielectric sheet; $n_i(r)$ represents refractive indices of points in a $i^{th}$ impedance matching layer that have a distance of r from a center of the $i^{th}$ impedance matching layer; $n_g(r)$ represents refractive indices of points in the function dielectric sheet that have a distance of r from a center of the function dielectric sheet; $n_{min}$ represents a minimum refractive index of the function dielectric sheet; and c represents a number of the impedance matching layers. The function dielectric sheet is adapted to convert an electromagnetic wave emitted from a radiating source into a plane wave. The function dielectric sheet is divided into a plurality of concentric annular bodies that each have a curved side surface and that are closely attached to each other; a bottom surface of each of the annular bodies has a radius smaller than that of a top surface of the annular body; the electromagnetic wave exits in parallel from the top surface of each of the annular bodies after propagating through a lens; a line connecting the radiating source to a point on the bottom surface of a $i^{th}$ annular body and a line perpendicular to the function dielectric sheet form an angle θ therebetween, the angle θ uniquely corresponds to a curved surface within the $i^{th}$ annular body, and each point on the curved surface to which the angle θ uniquely corresponds has a same refractive index; and refractive indices of each of the annular bodies decrease gradually as the angle θ increases.

According to a preferred embodiment of the present invention, the impedance matching component further comprises a second plurality of impedance matching layers closely attached to a second side surface of the function dielectric sheet and distributed symmetrically with the first plurality of impedance matching layers, and a refractive index distribution of each of the second plurality of impedance matching layers is identical to that of a corresponding one of the first plurality of impedance matching layers that is disposed symmetrically therewith.

According to a preferred embodiment of the present invention, each of the impedance matching layers comprises a sheet-like substrate and a plurality of man-made microstructures attached on the substrate.

According to a preferred embodiment of the present invention, a line connecting the radiating source to a point on an outer circumference of the bottom surface of the $i^{th}$ annular body and a line perpendicular to the function dielectric sheet form an angle $\theta_i$ therebetween, i is a positive integer, and i decreases when it closes to the center of the function dielectric sheet; and the angle $\theta_i$ satisfies following formula:

$$\mathrm{sinc}(\theta_i) = \frac{d}{\lambda}(n_{max(i+1)} - n_{min(i)});$$

$$s \times \left(\frac{1}{\cos\theta_i} - \frac{1}{\cos\theta_{i-1}}\right) = \frac{d}{\mathrm{sinc}(\theta_{i-1})} n_{max(i)} - \frac{d}{\mathrm{sinc}(\theta_i)} n_{min(i)});$$

$$\text{where, } \mathrm{sinc}(\theta_i) = \frac{\sin(\theta_i)}{\theta_i},\ \mathrm{sinc}(\theta_{i-1}) = \frac{\sin(\theta_{i-1})}{\theta_{i-1}},\ \theta_0 = 0;$$

s is a distance from the radiating source to the function dielectric sheet; d is a thickness of the function dielectric sheet; λ is a wavelength of the electromagnetic wave; $n_{max(i)}$, $n_{min(i)}$ are a maximum refractive index and a minimum refractive index of the $i^{th}$ annular body; and $n_{max(i+1)}$, $n_{min(i+1)}$ are a maximum refractive index and a minimum refractive index of the $i+1^{th}$ annular body.

According to a preferred embodiment of the present invention, maximum refractive indices and minimum refractive indices of any two adjacent ones of the annular bodies satisfy:

$$n_{max(i)} - n_{min(i)} = n_{max(i+1)} - n_{min(i+1)}.$$

According to a preferred embodiment of the present invention, maximum refractive indices and minimum refractive indices of any three adjacent ones of the annular bodies satisfy:

$$n_{max(i+1)} - n_{min(i)} > n_{max(i+2)} - n_{min(i+1)}.$$

According to a preferred embodiment of the present invention, refractive indices of the $i^{th}$ annular body satisfy:

$$n_i(\theta) = \frac{\sin\theta}{d \times \theta}\left(n_{max(i)} \times d + s - \frac{s}{\cos\theta}\right),$$

where, θ is an angle formed by a line connecting the radiating source to a point on the bottom surface of the $i^{th}$ annular body and a line perpendicular to the function dielectric sheet.

According to a preferred embodiment of the present invention, a generatrix of an outer surface of the $i^{th}$ annular body is a circular arc segment, an intersection point between a perpendicular line, which is perpendicular to a line connecting the radiating source to a point on the outer circumference of the bottom surface of the $i^{th}$ annular body, and a surface of the function dielectric sheet that faces away from the radiating source is a circle center of the circular arc segment, and a perpendicular line segment between the intersection point and a point on the outer circumference of the bottom surface of the $i^{th}$ annular body is a radius of the circular arc segment.

According to a preferred embodiment of the present invention, a generatrix of an inner surface of the $i^{th}$ annular body is a circular arc segment, an intersection point between a perpendicular line, which is perpendicular to a line connecting the radiating source to a point on an inner circumference of the bottom surface of the $i^{th}$ annular body, and a surface of the function dielectric sheet that faces away from the radiating source is a circle center of the circular are segment, and a perpendicular line segment between the intersection point and a point on the outer circumference of the bottom surface of the $i^{th}$ region is a radius of the circular arc segment, where i≥2.

The technical solution further provides an antenna, which comprises a radiating source and a converging component capable of converging an electromagnetic wave emitted from the radiating source and adapted to convert the electromagnetic wave into a plane wave. The converging component comprises a function dielectric sheet and an impedance matching component. The impedance matching component is disposed on and closely attached to a first side surface of the function dielectric sheet, and the impedance matching component comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the first plurality of impedance matching layers and is a positive integer, and the serial number increases when it closes to the function dielectric sheet; $n_i(r)$ represents refractive indices of points in a $i^{th}$ impedance matching layer of the first plurality of impedance matching layers that have a distance of r from a center of the $i^{th}$ impedance matching layer; $n_g(r)$ represents refractive indices of points in the function dielectric sheet that have a distance of r from a center of the function dielectric sheet; $n_{min}$ represents a minimum refractive index of the function dielectric sheet; and c represents a number of the impedance matching layers;

the function dielectric sheet is adapted to convert an electromagnetic wave emitted from the radiating source into a plane wave. The function dielectric sheet is divided into a plurality of concentric annular bodies that each have a curved side surface and that are closely attached to each other; a bottom surface of each of the annular bodies has a radius smaller than that of a top surface of the annular body; the electromagnetic wave exits in parallel from the top surface of each of the annular bodies after propagating through a lens; a line connecting the radiating source to a point on the bottom surface of a $i^{th}$ annular body and a line perpendicular to the function dielectric sheet form an angle θ therebetween, the angle θ uniquely corresponds to a curved surface within the $i^{th}$ annular body, and each point on the curved surface to which the angle θ uniquely corresponds has a same refractive index; and refractive indices of each of the annular bodies decrease gradually as the angle θ increases.

The technical solutions of the present invention have the following benefits: by designing the refractive index distribution of each of the impedance matching layers to follow a certain rule, the reflection interferences and losses are further reduced. Thus, the energy consumption of the electromagnetic waves when propagating into the function dielectric sheet is reduced, which facilitates further transmission of the electromagnetic waves and improves performances of the antenna. Furthermore, by designing the abrupt transitions of the refractive indices of the function dielectric sheet of the converging component to follow a curved surface, the refraction, diffraction and reflection at the abrupt transition points can be significantly reduced. As a result, the problems caused by interferences are eased, which further improves performances of the antenna.

BRIEF DESCRIPTION OF THE DRAWINGS

Hereinafter, the present invention will be further described with reference to the attached drawings and embodiments thereof. In the attached drawings.

DETAILED DESCRIPTION OF THE INVENTION

Figure 1:
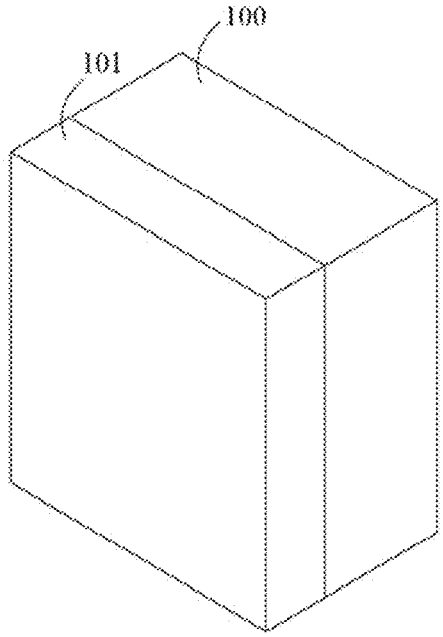
FIG. 1 is a perspective view of an impedance matching component and a function dielectric sheet according to an embodiment of the present invention.

FIG. 1 is a perspective view of an impedance matching component and a function dielectric sheet according to an embodiment of the present invention. The impedance matching component 101 is disposed on and closely attached to a first side surface of a function dielectric sheet 100. The function dielectric sheet 100 may be a dielectric sheet having any function (e.g., a converging function, a diverging function, a deflecting function and etc.) so long as the impedance matching component of the present invention can be used to reduce or eliminate reflection interferences and losses of an electromagnetic wave when propagating through an interface between two different media.

The impedance matching component 101 comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the first plurality of impedance matching layers and is a positive integer, and the serial number increases when it closes to the function dielectric sheet 100; $n_i(r)$ represents refractive indices of points in the $i^{th}$ impedance matching layer that have a distance of r from a center of the $i^{th}$ impedance to matching layer; $n_g(r)$ represents refractive indices of points in the function dielectric sheet 100 that has a distance of r from a center of the function dielectric sheet; $n_{min}$ represents the minimum refractive index of the function dielectric sheet; and c represents the number of the impedance matching layers.

According to the above formula, the refractive index distributions of the first, the second and the third impedance matching layers are represented as follows:

$$\text{the first layer: } n_1(r) = n_{min} \times \left(\frac{n_g(r)}{n_{min}}\right)^{\frac{1}{c+1}};$$

$$\text{the second layer: } n_2(r) = n_{min} \times \left(\frac{n_g(r)}{n_{min}}\right)^{\frac{2}{c+1}};$$

$$\text{the third layer: } n_3(r) = n_{min} \times \left(\frac{n_g(r)}{n_{min}}\right)^{\frac{3}{c+1}}; \ldots \ldots,$$

and so on. Therefore, the refractive index distribution of each of the impedance matching layers of the impedance matching component can be derived from the above formula as long as the refractive index distribution of the function dielectric sheet is known.

Figure 2:
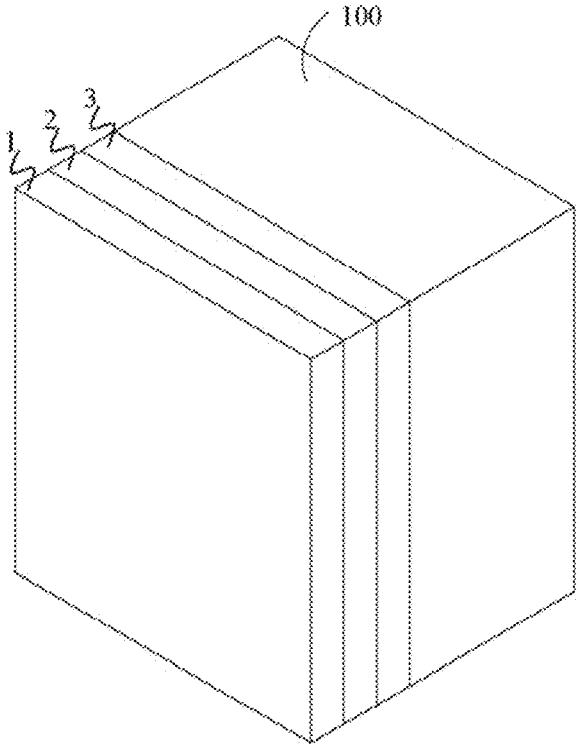
FIG. 2 is a schematic structural view of an impedance matching component according to an embodiment of the present invention.

As shown in FIG. 2, the impedance matching component 101 comprises three impedance matching layers with the serial numbers of 1, 2, 3 respectively. However, the number of impedance matching layers described herein is only for purpose of illustration but not to limit the present invention. The third impedance matching layer (with the serial number of 3) is closely attached to the function dielectric sheet.

Figure 3:
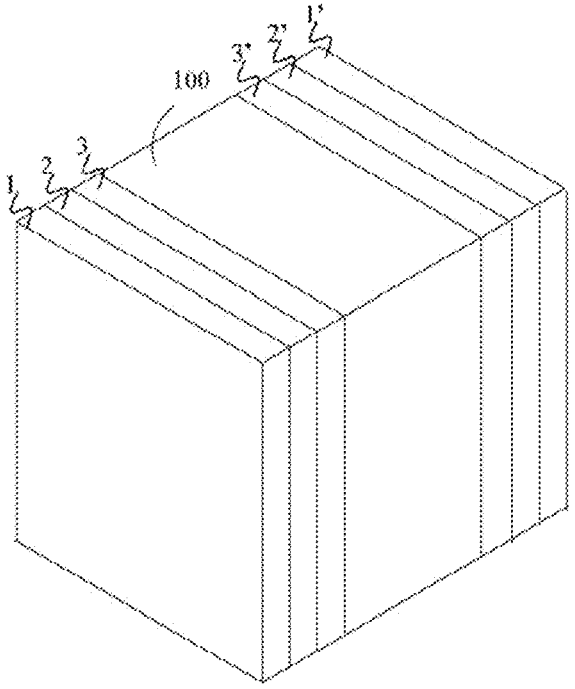
FIG. 3 is a schematic structural view of an impedance matching component according to an embodiment of the present invention.

In another embodiment of the present invention, the other side surface of the function dielectric sheet 100 may also be provided with a plurality of impedance matching layers. That is, the impedance matching component 101 further comprises a second plurality of impedance matching layers closely attached to the second side surface of the function dielectric sheet 100 and distributed symmetrically with the first plurality of impedance matching layers. A refractive index distribution of each of the second plurality of impedance matching layers is identical to that of a corresponding one of the first plurality of impedance matching layers that is disposed symmetrically therewith. As shown in FIG. 3, three impedance matching layers are also disposed on the second side surface of the function dielectric sheet 100, with the third impedance matching layer (with the serial number of 3') being closely attached to the function dielectric sheet. However, the number of impedance matching layers described herein is also only for purpose of illustration but not to limit the present invention. The impedance matching layers on the two side surfaces of the function dielectric sheet 100 are distributed symmetrically with each other. Taking the case of three impedance matching layers shown in FIG. 3 as an example, the impedance matching layer with the serial number of 1 at the left side and the impedance matching layer with the serial number of 1 at the right side have the same refractive index distribution as each other. i.e., both have a refractive index distribution of $$n_1(r) = n_{min} \times \left(\frac{n_g(r)}{n_{min}}\right)^{\frac{1}{c+1}};$$

the impedance matching layer with the serial number of 2 at the left side and the impedance matching layer with the serial number of 2' at the right side have the same refractive index distribution as each other, i.e. both have a refractive index distribution of $$n_2(r) = n_{min} \times \left(\frac{n_g(r)}{n_{min}}\right)^{\frac{2}{c+1}};$$

and the impedance matching layer with the serial number of 3 at the left side and the impedance matching layer with the serial number of 3' at the right side have the same refractive index distribution as each other, i.e., both have a refractive index distribution of $$n_3(r) = n_{min} \times \left(\frac{n_g(r)}{n_{min}}\right)^{\frac{3}{c+1}}.$$

Figure 4:
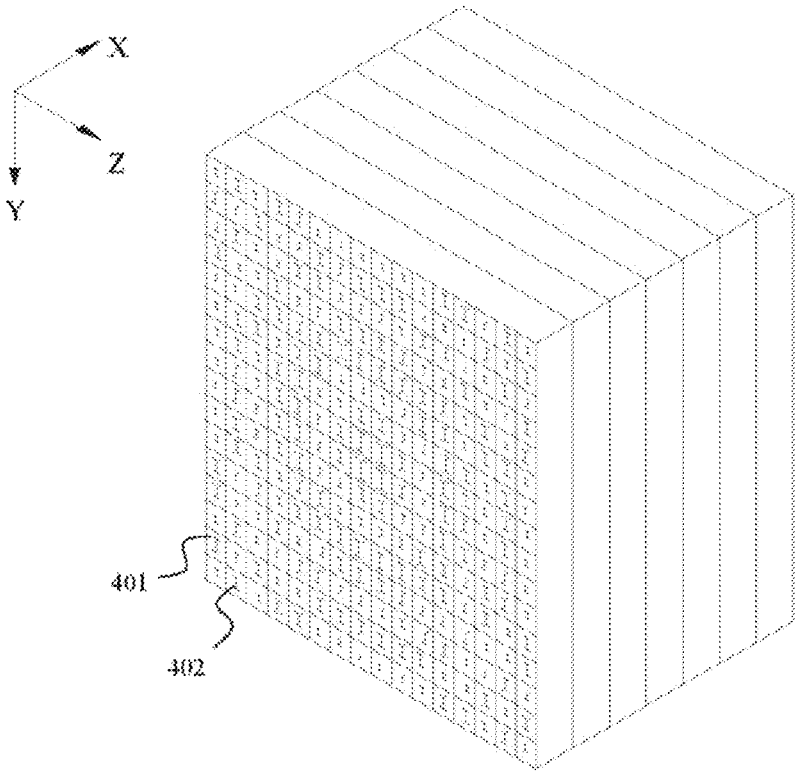
FIG. 4 is a schematic structural view of a function dielectric sheet according to an embodiment of the present invention.

The present invention has no limitation on the material of the function dielectric sheet; for example, the function dielectric sheet may be made of a metamaterial. Hereinbelow, a function dielectric sheet capable of converging an electromagnetic wave will be taken as an example for description. As shown in FIG. 4, the function dielectric sheet 100 comprises a plurality of metamaterial sheet layers. The metamaterial sheet layers are arranged and assembled together equidistantly, or are connected integrally with a front surface of one sheet layer being adhered to a back surface of an adjacent sheet layer. Each of the metamaterial sheet layers further comprises a sheet-like substrate and a plurality of man-made microstructures attached on the substrate. Each of the man-made microstructures is of a two-dimensional (2D) or three-dimensional (3D) structure comprising metal wires. The metal wires are copper wires or silver wires, and may be attached on the substrate through etching, electroplating, drilling, photolithography, electron etching or ion etching. Each of the man-made microstructures 402 and a portion of the substrate 401 that it occupies form one metamaterial unit. In practical implementations, the number of metamaterial sheet layers may be designed depending on practical needs. Each of the metamaterial sheet layers is formed of a plurality of metamaterial units arranged in an array, so the whole function dielectric sheet 100 may be considered to be formed by a plurality of metamaterial units arrayed in the x, y and z directions. Through design of the topological patterns, geometric dimensions and distributions thereof on the substrate 401 of the man-made microstructures 402, the following rules can be satisfied by the refractive index distribution: the refractive index distribution is the same for each of the metamaterial sheet layers, each of the metamaterial sheet layers comprises a circular region and a plurality of annular regions concentric with the circular region, refractive indices of each of the circular region and the annular regions decrease continuously from $n_p$ to $n_0$ as the radius thereof increases, and points at a same radius have the same refractive index.

Figure 5:
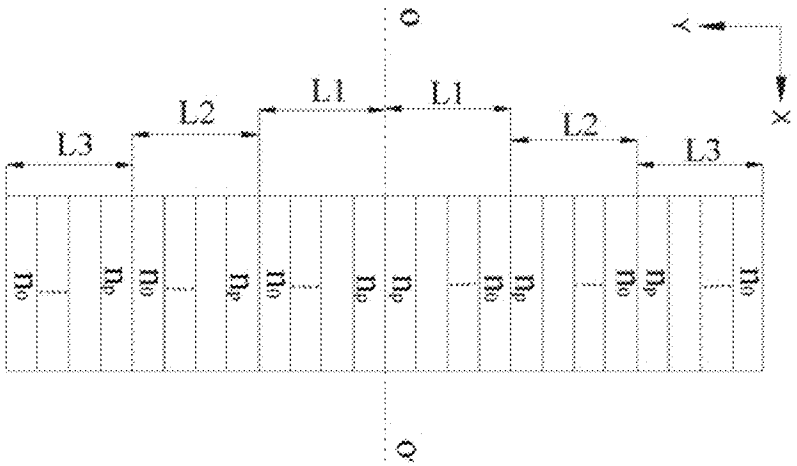
FIG. 5 is a schematic view illustrating refractive indices of metamaterial sheet layers versus a radius of the function dielectric sheet shown in FIG. 4.

A schematic view illustrating refractive indices of metamaterial sheet layers versus a radius of the function dielectric sheet is shown in FIG. 5. As an example, each of the metamaterial sheet layers comprises three regions: namely, a circular first region having a radius of L1, an annular second region having a width varying from L1 to L2, and an annular third region having a width varying from L2 to L3. The refractive indices of each of the three regions decrease gradually from $n_p$ (i.e., $n_{max}$) to $n^0$ (i.e., $n_{min}$) as the radius increases, where $n_p > n_0$. The refractive index distribution is the same for each of the metamaterial sheet layers. In practical applications, the maximum refractive index, the minimum refractive index, the number of metamaterial sheet layers or the like may all be modified depending on practical needs.

For the function dielectric sheet that satisfies the aforesaid rules of refractive index variations, with the metamaterial unit having the refractive index of $n_p$ as a circle center, the refractive index variations increase gradually on a yz plane as the radius increases. The deflection angle exhibited by the incident electromagnetic wave when exiting increases as the radius increases, and the closer a metamaterial unit is to the circle center, the smaller the exiting deflection angle of the electromagnetic wave will be. Through appropriate design and calculations, certain rules can be satisfied by the deflection angles so that an electromagnetic wave of a spherical form can exit in parallel. Similar to a convex lens, given that the deflection angle and the refractive index at each point of a surface are known, a corresponding surface curvature profile can be designed so that a divergent electromagnetic wave incident from a focus of the lens can exit in parallel. Likewise, by designing the man-made microstructures of each of the metamaterial units in the antenna based on the metamaterial of the present invention, a dielectric constant $\in$ and magnetic permeability $\mu$ of each of the metamaterial units can be obtained. Then, the refractive index distribution of the function dielectric sheet is designed in such a way that a specific deflection angle can be achieved for the electromagnetic wave through variations in refractive index between adjacent metamaterial units. Thereby, the electromagnetic wave that is divergent in the form of a spherical wave can be converted into a plane wave.

Figure 6:
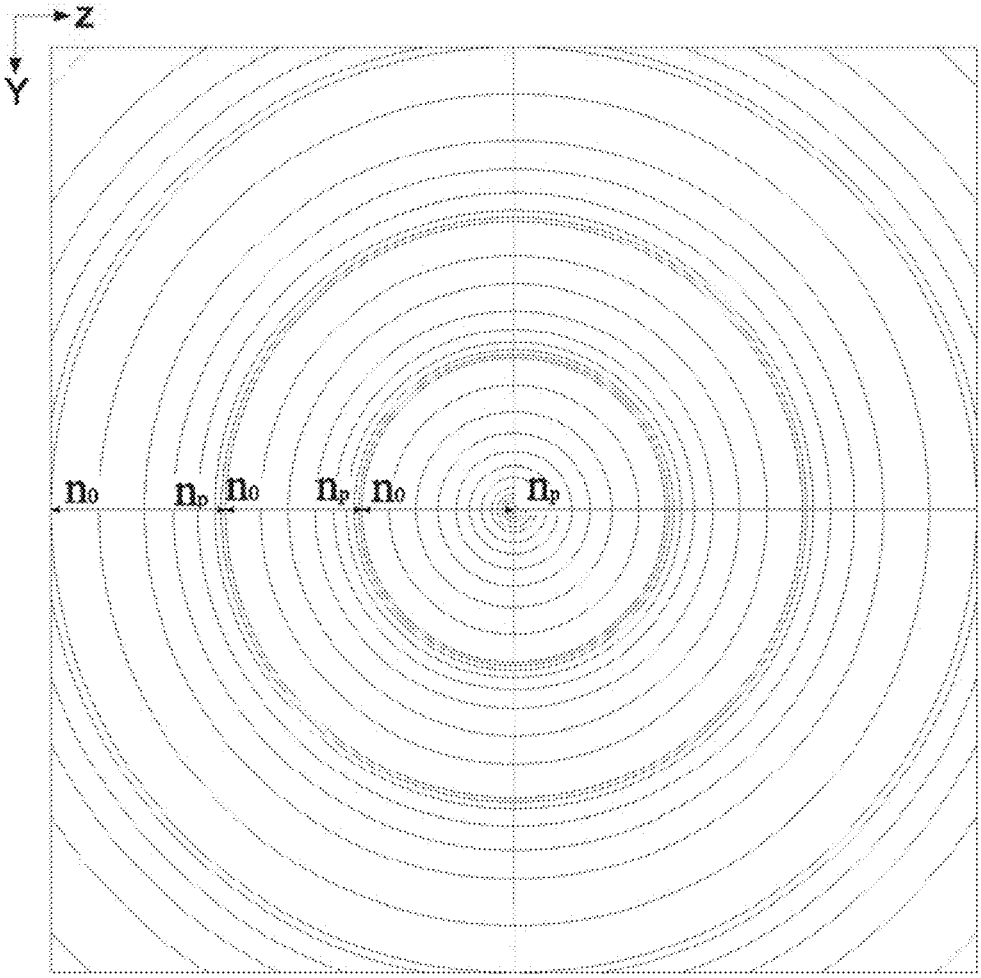
FIG. 6 is a view illustrating a refractive index distribution of a metamaterial sheet layer of the function dielectric sheet shown in FIG. 4 on a yz plane.

In order to more intuitively represent the refractive index distribution of each of the metamaterial sheet layers in the yz plane, the metamaterial units that have the same refractive index are connected to form a line, and the magnitude of the refractive index is represented by the density of the lines. A larger density of the lines represents a larger refractive index. The refractive index distribution of each of the metamaterial sheet layers satisfying all of the above relational expressions is as shown in FIG. 6, where the maximum refractive index is $n_p$ and the minimum refractive index is $n_0$.

Given that the incident electromagnetic wave is determined, the refractive index distribution of the function dielectric sheet can be adjusted by reasonably designing the topological patterns of the man-made microstructures 402 and the arrangement of the man-made microstructures 402 of different dimensions on the metamaterial sheet layers. In this way, the electromagnetic wave that is divergent in the form of a spherical wave can be converted into a plane wave.

The impedance matching layers described herein may be made of any materials that satisfy the aforesaid rules of refractive index distribution, and the present invention has no limitation thereon. In an embodiment of the present invention, each of the impedance matching layers comprises a sheet-like substrate and a plurality of man-made microstructures attached on the substrate. By reasonably designing the arrangement of the man-made microstructures on the substrate, the aforesaid rules of refractive index distribution can be achieved.

In order to more clearly demonstrate the effect of reducing the reflection losses accomplished by the impedance matching component of the present invention, far-field analysis and energy distribution analysis are made on an impedance matching component adopting the conventional equal difference design and an impedance matching component of the present invention respectively. The refractive indices of the impedance matching layers of the impedance matching component adopting the conventional equal difference design satisfy:

$$n(i) = n_{min} + \frac{i \times (n_g(r) - n_{min})}{i+1};$$

and the refractive indices of the impedance matching layers of the impedance matching component of the present invention satisfy:

$$n_i(r) = n_{min} \times \left(\frac{n_g(r)}{n_{min}}\right)^{\frac{i}{c+1}}.$$

$n_g(r)$ is a refractive index distribution function of the function dielectric sheet. Function dielectric sheets used with the two impedance matching components are identical to each other (e.g., both as shown in FIG. 4), so the $n_g(r)$ is the same in both cases.

As can be known from experiments, the energy distribution profile of the impedance matching component adopting the conventional equal difference design is much vaguer than that of the impedance matching component of the present invention. As is already known, the more the reflection is, the vaguer the energy distribution profile will be. Thus, the impedance matching component adopting the conventional design suffers from more reflection and, therefore, more losses. Provided that an identical function dielectric sheet and a same number of impedance matching layers are used in both cases, the energy of the electromagnetic wave after propagating through the impedance matching component adopting the conventional equal difference design is 4443 mW, while the energy of the electromagnetic wave after propagating through the impedance matching component of the present invention is 5251 mW. As the far-field analysis results obtained from the experiments reveal, the reflection of the impedance matching component adopting the conventional design is more than that of the impedance matching component of the present invention. Accordingly, the improved refractive index distribution of the present invention has the effect of further reducing the reflection interferences and losses.

Figure 7:
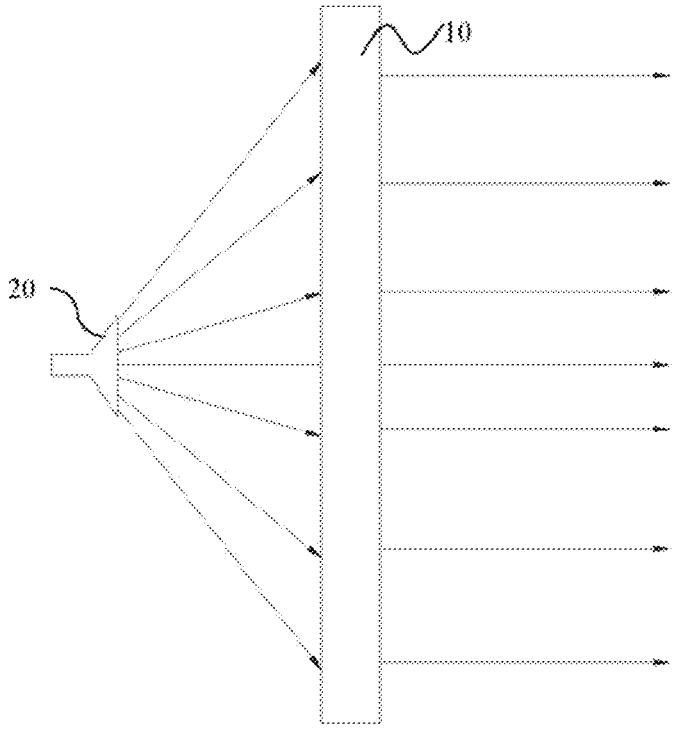
FIG. 7 is a schematic view illustrating how a metamaterial antenna converges an electromagnetic wave according to an embodiment of the present invention.

FIG. 7 is a schematic view illustrating how a metamaterial antenna converges an electromagnetic wave according to an embodiment of the present invention. The antenna comprises a radiating source 20 and a metamaterial panel 10 capable of converging an electromagnetic wave. The metamaterial panel 10 is adapted to convert an electromagnetic wave emitted from the radiating source into a plane wave. The converging effect of the antenna on the electromagnetic wave is as shown in FIG. 1.

As can be known as a common knowledge, the refractive index for the electromagnetic wave is directly proportional to $\sqrt{\in \times \mu}$. When an electromagnetic wave propagates from one medium into another, the electromagnetic wave will be refracted. If the refractive index distribution in the material is non-uniform, then the electromagnetic wave will be deflected in a direction towards a larger refractive index. By designing electromagnetic parameters of the metamaterial at each point, the refractive index distribution of the metamaterial can be adjusted so as to achieve the purpose of changing the propagating path of the electromagnetic wave. According to the aforesaid principle, by designing the refractive index distribution of the metamaterial panel 10, an electromagnetic wave radiated from the radiating source 20 and diverging in the form of a spherical wave can be converted into an electromagnetic wave in the form of a plane wave that is suitable for long-distance transmission.

The metamaterial panel 10 comprises the impedance matching component 101 and the function dielectric sheet 100 shown in the embodiment of FIG. 1. The impedance matching component 101 is disposed on and closely attached to a first side surface of the function dielectric sheet 100. The function dielectric sheet 100 may be a dielectric sheet having any function (e.g., a converging function, a diverging function, a deflecting function and etc.) so long as the impedance matching component of the present invention can be used to reduce or eliminate reflection interferences and losses of an electromagnetic wave when propagating through an interface between two different media. For detailed technical features of the impedance matching component 101 and the function dielectric sheet 100, reference may be made to the embodiment described with respect to FIG. 1 to FIG. 6, and no further description will be made herein.

Figure 8:
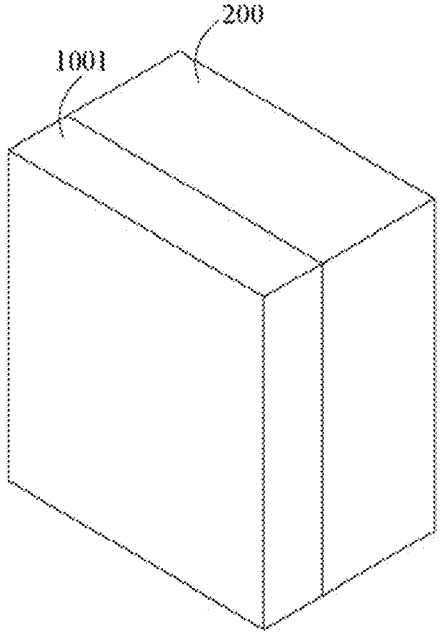
FIG. 8 is a perspective view of a converging component according to an embodiment of the present invention.

FIG. 8 is a perspective view of a converging component according to an embodiment of the present invention. The converging component comprises an impedance matching component 1001 and a function dielectric sheet 200. The impedance matching component 1001 is disposed on and closely attached to a first side surface of the function dielectric sheet 200.

The impedance matching component 101 comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the impedance matching layers and is a positive integer, and the serial number increases when it closes to the function dielectric sheet 200; $n_i(r)$ represents refractive indices of points in the $i^{th}$ impedance matching layer that have a distance of r from a center of the $i^{th}$ impedance matching layer; $n_g(r)$ represents refractive indices of points in the function dielectric sheet 100 that has a distance of r from a center of the function dielectric sheet; $n_{min}$ represents the minimum refractive index of the function dielectric sheet; and c represents the number of the impedance matching layers.

According to the above formula, the refractive index distributions of the first, the second and the third impedance matching layers are represented as follows:

$$\text{the first layer: } n_1(r) = n_{min} \times \left(\frac{n_g(r)}{n_{min}}\right)^{\frac{1}{c+1}};$$

-continued $$\text{the second layer: } n_2(r) = n_{min} \times \left(\frac{n_g(r)}{n_{min}}\right)^{\frac{2}{c+1}};$$

$$\text{the third layer: } n_3(r) = n_{min} \times \left(\frac{n_g(r)}{n_{min}}\right)^{\frac{3}{c+1}}; \ldots \ldots,$$

and so on. Therefore, the refractive index distribution of each of the impedance matching layers of the impedance matching component can be derived from the above formula as long as the refractive index distribution of the function dielectric sheet is known.

Figure 9:
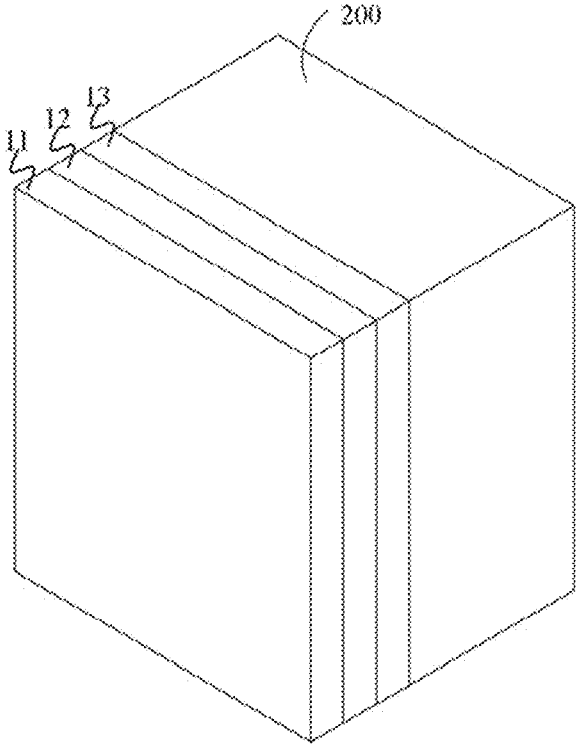
FIG. 9 is a schematic structural view of an impedance matching component according to an embodiment of the present invention.

As shown in FIG. 9, the impedance matching component 1001 comprises three impedance matching layers with the serial numbers of 11, 12, 13 respectively. However, the number of impedance matching layers described herein is only for purpose of illustration but not to limit the present invention. The third impedance matching layer (with the serial number of 13) is closely attached to the function dielectric sheet.

Figure 10:
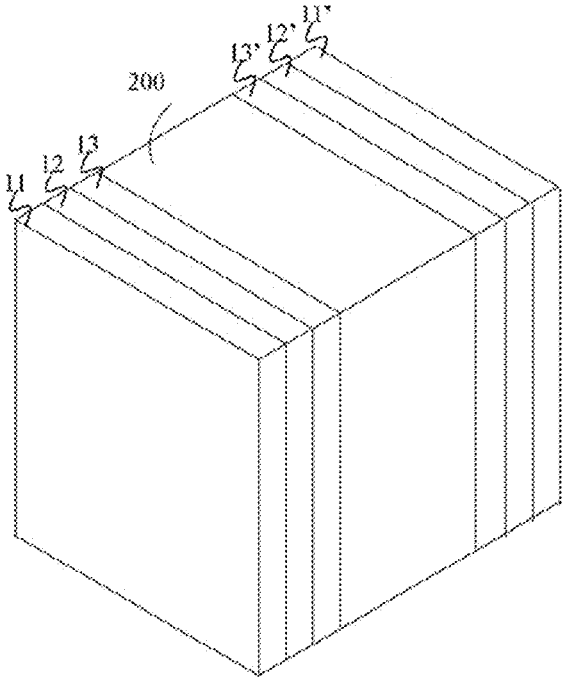
FIG. 10 is a schematic structural view of an impedance matching component according to another embodiment of the present invention.

In another embodiment of the present invention, the other side surface of the function dielectric sheet 200 may also be provided with a plurality of impedance matching layers. That is, the impedance matching component 1001 further comprises a second plurality of impedance matching layers closely attached to the second side surface of the function dielectric sheet 200 and distributed symmetrically with the first plurality of impedance matching layers. A refractive index distribution of each of the second plurality of impedance matching layers is identical to that of a corresponding one of the first plurality of impedance matching layers that is disposed symmetrically therewith. As shown in FIG. 10, three impedance matching layers are also disposed on the second side surface of the function dielectric sheet 200, with the third impedance matching layer (with the serial number of 13') being closely attached to the function dielectric sheet. However, the number of impedance matching layers described herein is also only for purpose of illustration but not to limit the present invention. The impedance matching layers on the two side surfaces of the function dielectric sheet 200 are distributed symmetrically with each other. Taking the case of three impedance matching layers shown in FIG. 10 as an example, the impedance matching layer with the serial number of 11 at the left side and the impedance matching layer with the serial number of 11' at the right side have the same refractive index distribution as each other, i.e., both have a refractive index distribution of $$n_1(r) = n_{min} \times \left(\frac{n_g(r)}{n_{min}}\right)^{\frac{1}{c+1}};$$

the impedance matching layer with the serial number of 12 at the left side and the impedance matching layer with the serial number of 12' at the right side have the same refractive index distribution as each other, i.e., both have a refractive index distribution of $$n_2(r) = n_{min} \times \left(\frac{n_g(r)}{n_{min}}\right)^{\frac{2}{c+1}};$$

and the impedance matching layer with the serial number of 13 at the left side and the impedance matching layer with the serial number of 13' at the right side have the same refractive index distribution as each other, i.e., both have a refractive index distribution of $$n_3(r) = n_{min} \times \left(\frac{n_g(r)}{n_{min}}\right)^{\frac{3}{c+1}}.$$

Figure 11:
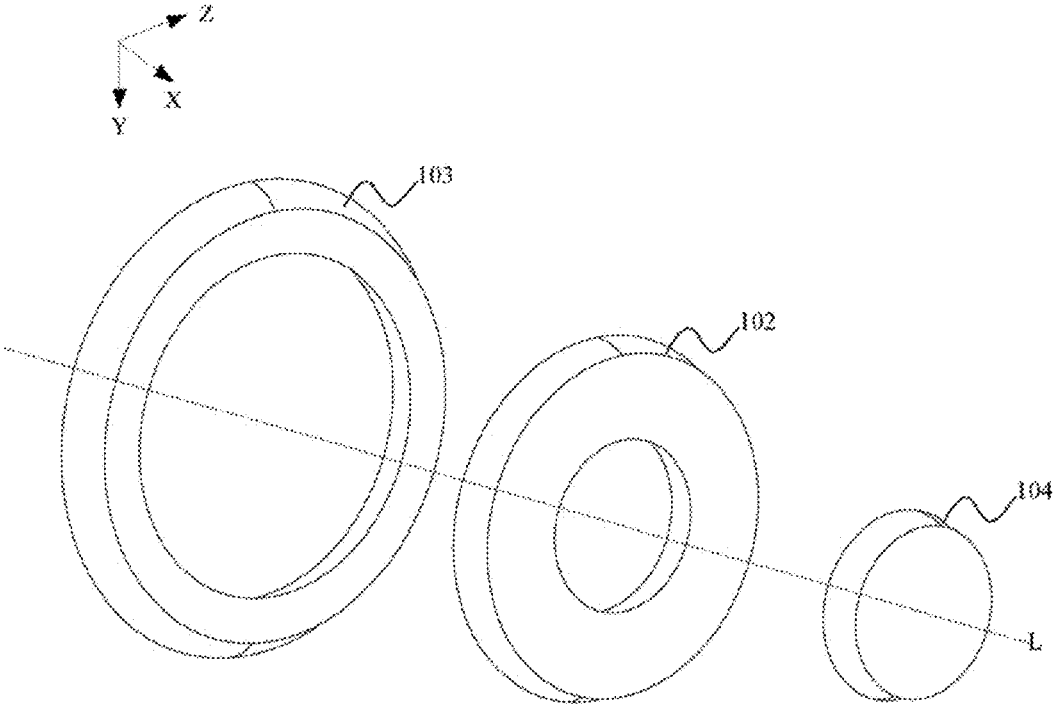
FIG. 11 is a schematic structural view of a function dielectric sheet 200.

The present invention has no limitation on the material of the function dielectric sheet; for example, the function dielectric sheet may be made of a metamaterial. Hereinbelow the function dielectric sheet will be described. FIG. 11 is a schematic structural view of a function dielectric sheet 200. The function dielectric sheet 200 is divided into a plurality of concentric annular bodies that each have a curved side surface (s) and that are closely attached to each other; a bottom surface of each of the annular bodies has a radius smaller than that of a top surface of the annular body; the electromagnetic wave exits in parallel from the top surface of each of the annular bodies after propagating through a lens; a line connecting the radiating source to a point on the bottom surface of the $i^{th}$ annular body and a line perpendicular to the function dielectric sheet form an angle θ therebetween. The angle θ uniquely corresponds to a curved surface within the $i^{th}$ annular body, and each point on the curved surface to which the angle θ uniquely corresponds has the same refractive index; and the refractive indices of each of the annular bodies decrease gradually as the angle θ increases. In practical applications, the lens per se may not be a combination of a plurality of annular bodies but is an integral lens body provided that the aforesaid refractive index distribution rules are satisfied. For purpose of description, the lens is illustrated to be divided into a plurality of annular bodies, but this is not intended to limit the present invention.

Figure 12:
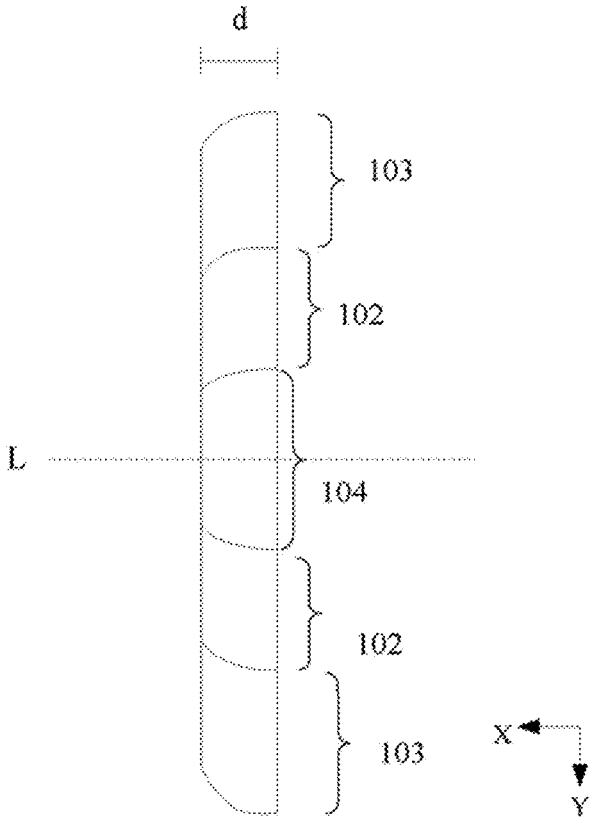
FIG. 12 is a side view of the function dielectric sheet 200 shown in FIG. 11.

It shall be appreciated that, the first annular body is a solid annular body, i.e., it has only one curved side surface. Other annular bodies than the first annular body all have two side surfaces (i.e., an inner surface and an outer surface) as shown in FIG. 11. The function dielectric sheet shown in FIG. 11 comprises three annular bodies (104, 102, 103). In order to show the structure of each of the annular bodies of the function dielectric sheet 200 clearly, FIG. 1 is depicted in the form of a schematic exploded view. In practical use, the three annular bodies are closely attached together to form a complete function dielectric sheet. The number of annular bodies shown herein is only for purpose of illustration but not to limit the present invention. The annular body 104 is the first annular body, the annular body 102 is the second annular body, and the annular body 103 is the third annular body. FIG. 12 is a side view of the function dielectric sheet 200 comprising the three annular bodies (104, 102, 103), where d represents a thickness of the function dielectric sheet 200 and L represents a line perpendicular to the function dielectric sheet 200. As can be seen from FIG. 12, each of the annular bodies corresponds to a circular are segment in the side view, and refractive indices of points on a same circular arc are identical to each other (i.e., refractive indices of points on a curved surface formed by the circular arc segment on the annular body are identical to each other).

Assume that a line connecting the radiating source to a point on an outer circumference of the bottom surface of the $i^{th}$ annular body and a line perpendicular to the function dielectric sheet 200 include an angle $\theta_i$ therebetween, i is a positive integer, and the serial number i decreases when it closes to a center of the function dielectric sheet 200. The angle $\theta_i$ satisfies the following formula:

$$\sin c(\theta_i) = \frac{d}{\lambda}(n_{max(i+1)} - n_{min(i)});$$

$$s \times \left(\frac{1}{\cos\theta_i} - \frac{1}{\cos\theta_{i-1}}\right) = \frac{d}{\sin c(\theta_{i-1})} n_{max(i)} - \frac{d}{\sin c(\theta_i)} n_{min(i)}\Big);$$

where, $$\sin c(\theta_i) = \frac{\sin(\theta_i)}{\theta_i},$$

$$\sin c(\theta_{i-1}) = \frac{\sin(\theta_{i-1})}{\theta_{i-1}},$$

$$\theta_0 = 0;$$

s is a distance from the radiating source to the function dielectric sheet 200; d is a thickness of the function dielectric sheet 200; λ is a wavelength of the electromagnetic wave; $n_{max(i)}$, $n_{min(i)}$ are the maximum refractive index and the minimum refractive index of the $i^{th}$ annular body; and $n_{max(i+1)}$, $n_{min(i+1)}$ are the maximum refractive index and the minimum refractive index of the $(i+1)^{th}$ annular body. The maximum refractive indices and the minimum refractive indices of any two adjacent ones of the annular bodies satisfy:

$$n_{max(i)} - n_{min(i)} = n_{max(i+1)} - n_{min(i+1)}.$$

Figure 13:
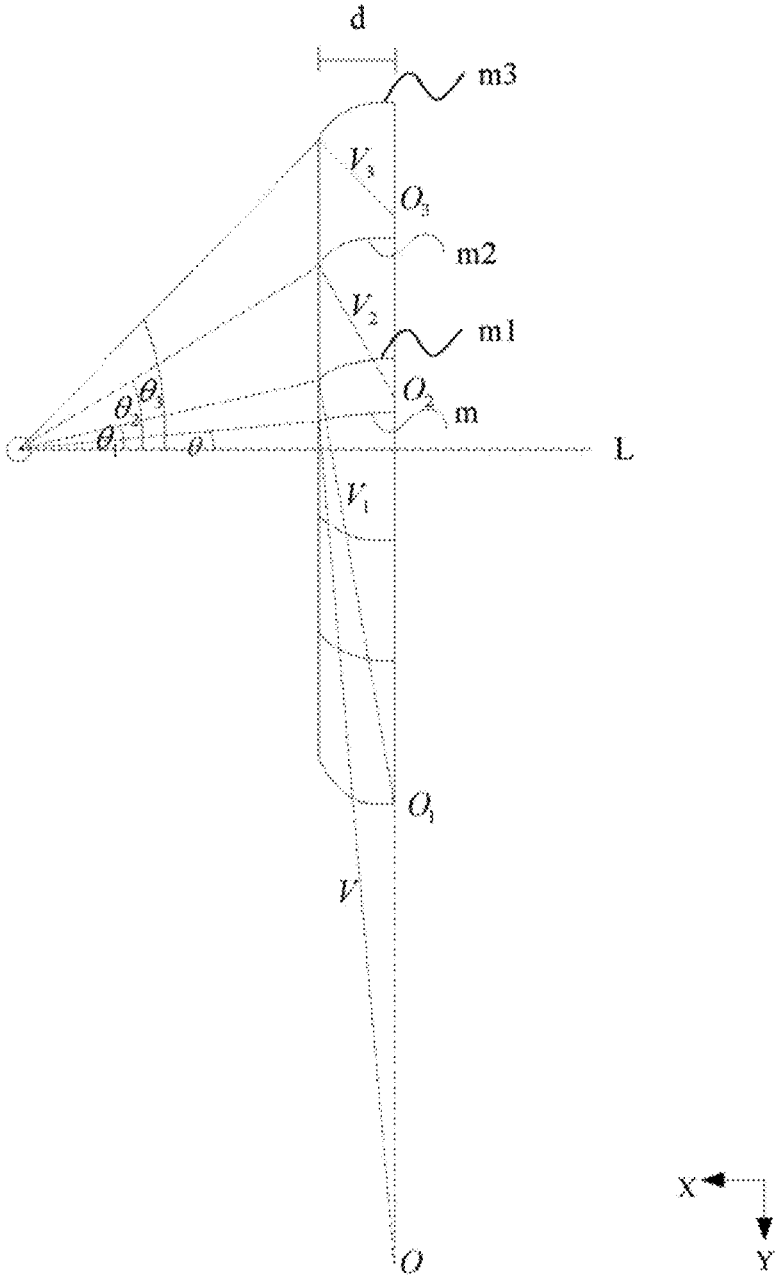
FIG. 13 is a schematic view illustrating constructions of circular arc segments shown in FIG. 12.

As shown in FIG. 13, assuming that both $n_{max(1)}$ and $n_{min(1)}$ are known, then $\theta_1$ of the first annular body and $n_{max(2)}$ may be calculated as follows:

$$\sin c(\theta_1) = \frac{d}{\lambda}(n_{max(2)} - n_{min(1)});$$

$$s \times \left(\frac{1}{\cos\theta_1} - 1\right) = \frac{d}{\sin c(\theta_0)} n_{max(1)} - \frac{d}{\sin c(\theta_1)} n_{min(1)}\Big).$$

$\theta_2$ of the second annular body and $n_{max(3)}$ may be calculated as follows:

$$\sin c(\theta_2) = \frac{d}{\lambda}(n_{max(3)} - n_{min(2)});$$

$$s \times \left(\frac{1}{\cos\theta_2} - \frac{1}{\cos\theta_1}\right) = \frac{d}{\sin c(\theta_1)} n_{max(2)} - \frac{d}{\sin c(\theta_2)} n_{min(2)}\Big).$$

$\theta_3$ of the third annular body may be calculated as follows:

$$\sin c(\theta_3) = \frac{d}{\lambda}(n_{max(4)} - n_{min(3)});$$

$$s \times \left(\frac{1}{\cos\theta_3} - \frac{1}{\cos\theta_2}\right) = \frac{d}{\sin c(\theta_2)} n_{max(3)} - \frac{d}{\sin c(\theta_3)} n_{min(3)}\Big).$$

In an embodiment of the present invention, the maximum refractive indices and the minimum refractive indices of any three adjacent ones of the annular bodies satisfy:

$$n_{max(i+1)} - n_{min(i)} > n_{max(i+2)} - n_{min(i+1)}.$$

As shown in FIG. 13, a generatrix of each of the side surfaces (including an outer surface and an inner surface) of each of the annular bodies is a circular arc segment. The generatrix of the outer surface of the $i^{th}$ annular body is a circular arc segment, and the circular arc segments shown in the side view are just generatrices of the outer surfaces of the annular bodies. An intersection point between a perpendicular line, which is perpendicular to a line connecting the radiating source to a point on the outer circumference of the bottom surface of the $i^{th}$ annular body, and a surface of the function dielectric sheet 200 that faces away from the radiating source is a circle center of the circular arc segment; and a perpendicular line segment between the intersection point and a point on the outer circumference of the bottom surface of the $i^{th}$ annular body is a radius of the circular arc segment.

The generatrix of the inner surface of the $i^{th}$ annular body is also a circular arc segment. An intersection point between a perpendicular line, which is perpendicular to a line connecting the radiating source to a point on an inner circumference of the bottom surface of the $i^{th}$ annular body, and a surface of the function dielectric sheet 200 that faces away from the radiating source is a circle center of the circular arc segment; and a perpendicular line segment between the intersection point and a point on the outer circumference of the bottom surface of the $i^{th}$ region is a radius of the circular arc segment, where $i \geq 2$. Because the first annular body is solid, it has no inner surface. The inner surface of the $(i+1)^{th}$ annular body is closely attached to the outer surface of the $i^{th}$ annular body, i.e, curvatures of points on the inner surface of the $(i+1)^{th}$ annular body are identical to those of points on the outer surface of the $i^{th}$ annular body. Each of the annular bodies has the maximum refractive index on the inner surface thereof and the minimum refractive index on the outer surface thereof.

A line connecting the radiating source to a point on the outer circumference of the bottom surface of the first annular body and the line L form an angle $\theta_1$ therebetween, an intersection point between a perpendicular line segment $V_1$, which is perpendicular to the line connecting the radiating source to a point on the outer circumference of the bottom surface of the first annular body, and the other surface of the function dielectric sheet 200 is $O_1$; and the outer surface of the first annular body has a generatrix m1, which is a circular arc segment obtained through rotation with the intersection point $O_1$ as a circle center and the perpendicular line segment $V_1$ as a radius. Likewise, a line connecting the radiating source to a point on the outer circumference of the bottom surface of the second annular body and the line L include an angle $\theta_2$ therebetween; an intersection point between a perpendicular line segment $V_2$, which is perpendicular to the line connecting the radiating source to a point on the outer circumference of the bottom surface of the second annular body, and the other surface of the function dielectric sheet 200 is $O_2$; and the outer surface of the second annular body has a generatrix m2, which is a circular arc segment obtained through rotation with the intersection point $O_2$ as a circle center and the perpendicular line segment $V_2$ as a radius. A line connecting the radiating source to a point on the outer circumference of the bottom surface of the third annular body and the line L include an angle $\theta_3$ therebetween; an intersection point between a perpendicular line segment $V_3$, which is perpendicular to the line connecting the radiating source to a point on the outer circumference of the bottom surface of the third annular body, and the other surface of the function dielectric sheet 200 is $O_3$; and the outer surface of the third annular body has a generatrix m3, which is a circular arc segment obtained through rotation with the intersection point $O_3$ as a circle center and the vertical line segment $V_3$ as a radius. As shown in FIG. 12, the circular arc segments m1, m2, m3 are distributed symmetrically with respect to the line L.

For any of the annular bodies, supposing that a line connecting the radiating source to a point on the bottom surface of the $i^{th}$ annular body and the line perpendicular to the function dielectric sheet 200 form an angle θ therebetween, then the refractive index $n_i(\theta)$ of the $i^{th}$ annular body varying with the angle θ satisfies the following rule:

$$n_i(\theta) = \frac{\sin\theta}{d \times \theta}\left(n_{max(i)} \times d + s - \frac{s}{\cos\theta}\right),$$

where $n_{max(i)}$ is the maximum refractive index of the $i^{th}$ annular body. The angle θ uniquely corresponds to a curved surface in the $i^{th}$ annular body, and each point on the curved surface to which the angle θ uniquely corresponds has a same refractive index. The angle θ has a range of $$[0, \frac{\pi}{2}).$$

As shown in FIG. 13, taking the first annular body as an example, a line connecting the radiating source to a point on the bottom surface of the first annular body and a line perpendicular to the function dielectric sheet 200 include an angle θ therebetween; an intersection point between a perpendicular line segment V, which is perpendicular to the line connecting the radiating source to the point on the bottom surface of the first annular body, and the other surface of the function dielectric sheet 200 is O; and the generatrix m is a circular arc segment obtained through rotation with the intersection point O as a circle center and the perpendicular line segment V as a radius. Each point on the curved surface to which the angle θ uniquely corresponds has the same refractive index.

Figure 14:
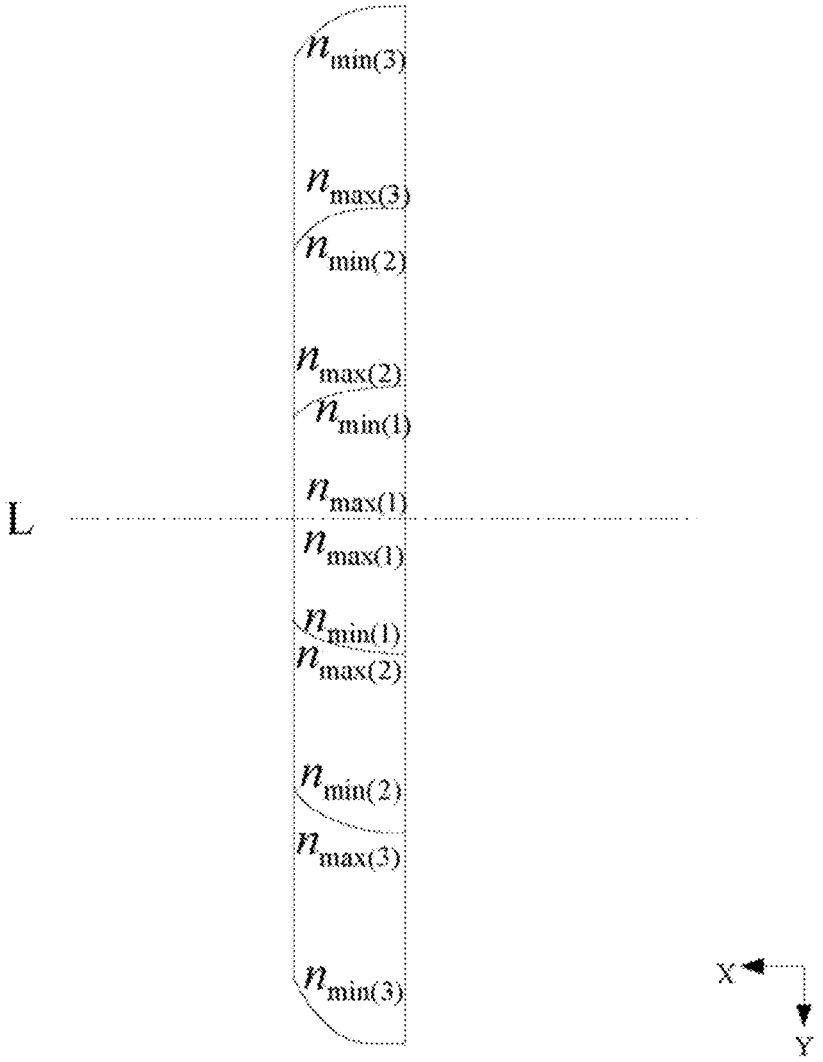
FIG. 14 is a schematic view illustrating variations of refractive indices of the function dielectric sheet 200.

The function dielectric sheet 200 is adapted to convert an electromagnetic wave emitted from the radiating source into a plane wave. The refractive indices of each of the annular bodies thereof decrease from $n_{max(i)}$ to $n_{min(i)}$ as the angle θ increases, and a schematic view of the refractive indices versus the radius is shown in FIG. 14.

In practical structure designs, the metamaterial may be designed to comprise a plurality of metamaterial sheet layers, each of which comprises a sheet-like substrate and a plurality of man-made microstructures or man-made pore structures attached on the substrate. The overall refractive index distribution of the plurality of metamaterial sheet layers combined together must satisfy or approximately satisfy the aforesaid formulas so that refractive indices on a same curved surface are identical to each other, and the generatrix of the curved surface is designed as a circular arc. Of course, in practical designs, it may be relatively difficult to design the generatrix of the curved surface as an accurate circular arc, so the generatrix of the curved surface may be designed as an approximate circular arc or a stepped form as needed and the degree of accuracy may be chosen as needed. With continuous advancement of the technologies, the designing manners are also updated continuously, and there may be a better designing process for the metamaterial to achieve the refractive index distribution provided by the present invention.

Each of the man-made microstructures is a two-dimensional (2D) or three-dimensional (3D) structure consisting of at least one metal wire and having a geometric pattern, and may be of, for example but is not limited to, an "+" form, a 2D snowflake form or a 3D snowflake form. The at least one metal wire may be at least one copper wire or silver wire, and may be attached on the substrate through etching, electroplating, drilling, photolithography, electron etching or ion etching. The plurality of man-made microstructures in the metamaterial make refractive indices of the metamaterial decrease as the angle θ increases. Given that an incident electromagnetic wave is known, by reasonably designing topology patterns of the man-made microstructures and designing arrangement of the man-made microstructures of different dimensions within an electromagnetic wave converging component, the refractive index distribution of the metamaterial can be adjusted to convert an electromagnetic wave diverging in the form of a spherical wave into a plane electromagnetic wave.

Figure 15:
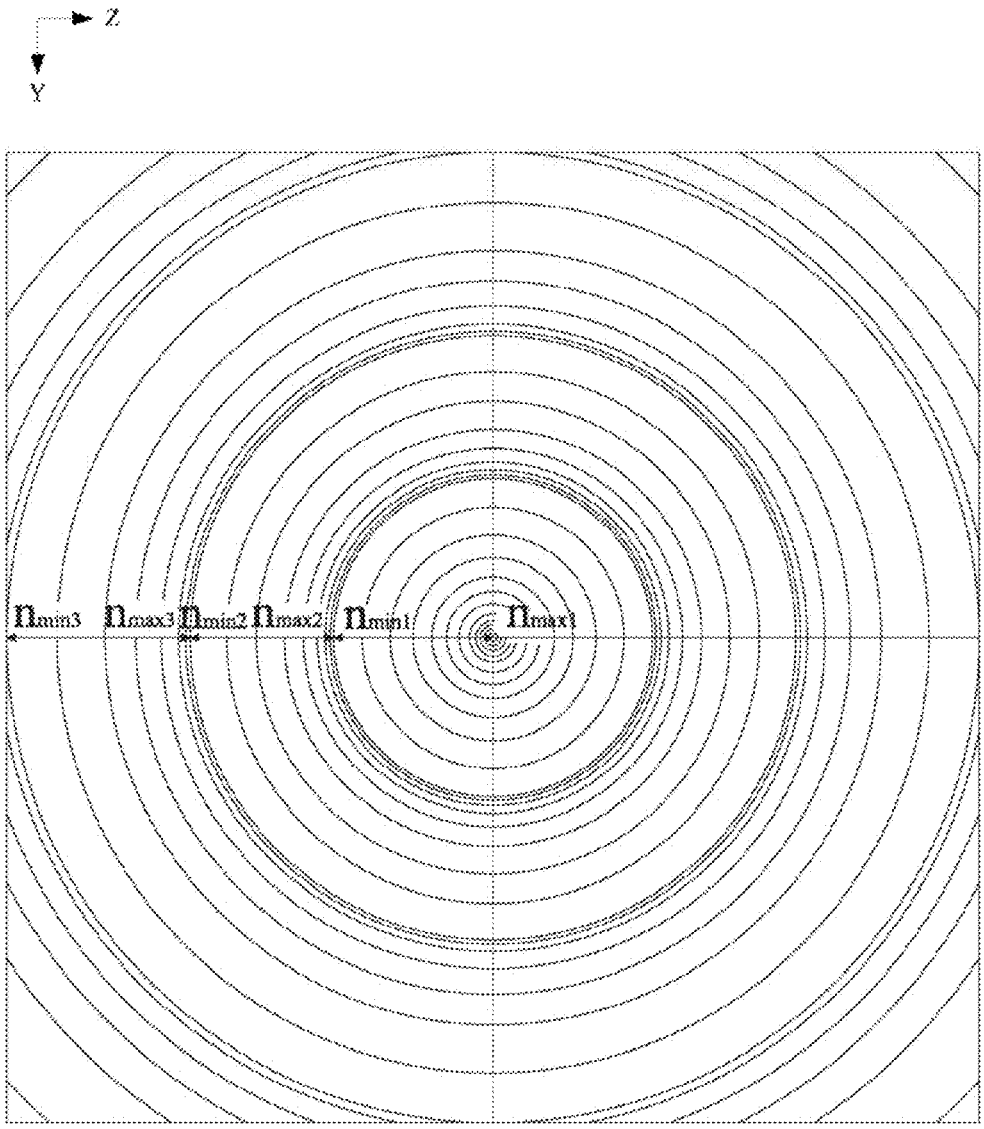
FIG. 15 is a view illustrating a refractive index distribution of the function dielectric sheet 200 on the yz plane.

In order to more intuitively represent the refractive index distribution of each of the metamaterial sheet layers in a yz plane, the units that have the same refractive index are connected to form a line, and the magnitude of the refractive index is represented by the density of the lines. A larger density of the lines represents a larger refractive index. The refractive index distribution of the function dielectric sheet satisfying all of the above relational expressions is as shown in FIG. 15.

The aforesaid function dielectric sheet 200 may be in the form shown in FIG. 11, and of course, may also be made into other desired forms so long as the aforesaid refractive index variation rules can be satisfied. The metamaterial of the present invention can be used as a lens and can also be used in antennae in the field of communication, and thus has a wide application scope.

The impedance matching layers described herein may be made of any materials that satisfy the aforesaid rules of refractive index distribution, and the present invention has no limitation thereon. In an embodiment of the present invention, each of the impedance matching layers comprises a sheet-like substrate and a plurality of man-made microstructures attached on the substrate. By reasonably designing the arrangement of the man-made microstructures on the substrate, the aforesaid rules of refractive index distribution can be achieved.

In order to more clearly demonstrate the effect of reducing the reflection losses accomplished by the impedance matching component of the present invention, far-field analysis and energy distribution analysis are made on an impedance matching component adopting the conventional equal difference design and an impedance matching component of the present invention respectively. The refractive indices of the impedance matching layers of the impedance matching component adopting the conventional equal difference design satisfy:

$$n(i) = n_{min} + \frac{i \times (n_g(r) - n_{min})}{i+1};$$

and the refractive indices of the impedance matching layers of the impedance matching component of the present invention satisfy:

$$n_i(r) = n_{min} \times \left(\frac{n_g(r)}{n_{min}}\right)^{\frac{i}{c+1}}.$$

$n_g(r)$ is a refractive index distribution function of the function dielectric sheet. Function dielectric sheets used with the two impedance matching components are identical to each other (e.g., both as shown in FIG. 11), so the $n_g(r)$ is the same in both cases.

As can be known from experiments, the energy distribution profile of the impedance matching component adopting the conventional equal difference design is much vaguer than that of the impedance matching component of the present invention. As is already known, the more the reflection is, the vaguer the energy distribution profile will be. Thus, the impedance matching component adopting the conventional design suffers from more reflection and, therefore, more losses. Provided that an identical function dielectric sheet and a same number of impedance matching layers are used in both cases, the energy of the electromagnetic wave after propagating through the impedance matching component adopting the conventional equal difference design is 4443 mW, while the energy of the electromagnetic wave after propagating through the impedance matching component of the present invention is 5251 mW. As the far-field analysis results obtained from the experiments reveal, the reflection of the impedance matching component adopting the conventional design is more than that of the impedance matching component of the present invention. Accordingly, the improved refractive index distribution of the present invention has the effect of further reducing the reflection interferences and losses.

By designing the refractive index distribution of each of the impedance matching layers to follow a certain rule, the reflection interferences and losses are further reduced. Thus, the energy consumption of the electromagnetic waves when propagating into the function dielectric sheet is reduced, which facilitates further transmission of the electromagnetic waves. Furthermore, by designing the abrupt transitions of the refractive indices of the function dielectric sheet of the converging component to follow a curved surface, the refraction, diffraction and reflection at the abrupt transition points can be significantly reduced. As a result, the problems caused by interferences are eased, which further improves performances of the antenna.

Figure 16:
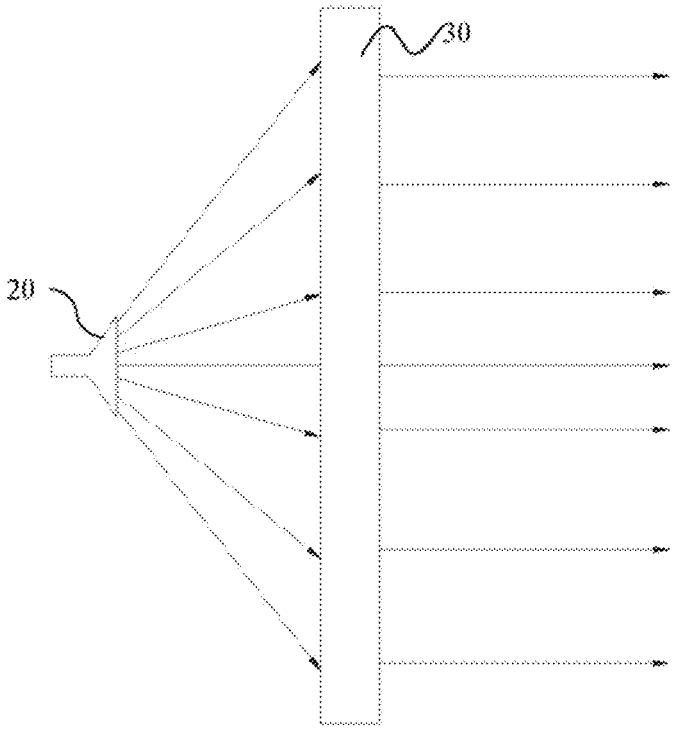
FIG. 16 is a schematic view illustrating how an antenna converges an electromagnetic wave according to an embodiment of the present invention.

FIG. 16 is a schematic view illustrating how an antenna converges an electromagnetic wave according to an embodiment of the present invention. The antenna comprises a radiating source 20 and a converging component 30 capable of converging an electromagnetic wave emitted from the radiating source and adapted to convert the electromagnetic wave into a plane wave.

As can be known as a common knowledge, the refractive index for the electromagnetic wave is directly proportional to $\sqrt{\in\times\mu}$. When an electromagnetic wave propagates from one medium into another, the electromagnetic wave will be refracted. If the refractive index distribution in the material is non-uniform, then the electromagnetic wave will be deflected in a direction towards a larger refractive index. By designing electromagnetic parameters of the metamaterial at each point, the refractive index distribution of the metamaterial can be adjusted so as to achieve the purpose of changing the propagating path of the electromagnetic wave. According to the aforesaid principle, by designing the refractive index distribution of the metamaterial panel, an electromagnetic wave radiated from the radiating source 20 and diverging in the form of a spherical wave can be converted into an electromagnetic wave in the form of a plane wave that is suitable for long-distance transmission.

The converging component 30 comprises the impedance matching component 1001 and the function dielectric sheet 200 shown in the embodiment of FIG. 8. The impedance matching component 1001 is disposed on and closely attached to a first side surface of the function dielectric sheet 200. For detailed technical features of the impedance matching component 1001 and the function dielectric sheet 200, reference may be made to the embodiment described with respect to FIG. 8 to FIG. 15, and no further description will be made herein.

The technical solutions of the present invention have the following benefits: by designing the refractive index distribution of each of the impedance matching layers to follow a certain rule, the reflection interferences and losses are further reduced. Thus, the energy consumption of the electromagnetic waves when propagating into the function dielectric sheet is reduced, which facilitates further transmission of the electromagnetic waves and improves performances of the antenna. Furthermore, by designing the abrupt transitions of the refractive indices of the function dielectric sheet of the converging component to follow a curved surface, the refraction, diffraction and reflection at the abrupt transition points can be significantly reduced. As a result, the problems caused by interferences are eased, which further improves performances of the antenna.

Preferred embodiments of the present invention have been described above with reference to the attached drawings; however, the present invention is not limited to the aforesaid embodiments, and these embodiments are only illustrative but are not intended to limit the present invention. Those of ordinary skill in the art may further devise many other implementations according to the teachings of the present invention without departing from the spirits and the scope claimed in the claims of the present invention, and all of the implementations shall fall within the scope of the present invention.

What is claimed is:

1. A panel, comprising:

an impedance matching component, being disposed on and adjacently attached to a first side surface of a function dielectric sheet layer, wherein the function dielectric sheet layer has a thickness between the first side surface and a second side surface and is configured such that the first and second side surfaces are parallel to each other such that waves enter the first side surface and exit the second side surface, wherein an electromagnetic wave diverging in the form of a spherical wave is emitted from a radiation source and incident on the first side surface, wherein the impedance matching component comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the first plurality of impedance matching layers and is a positive integer, and the serial number increases for each layer of the first plurality of impedance matching layers that gets closer to the function dielectric sheet layer; $n_i(r)$ represents refractive indices of points in an ith impedance matching layer of the first plurality of impedance matching layers that have a distance of r from a center of the ith impedance matching layer; $n_g(r)$ represents refractive indices of points in the function dielectric sheet layer that have a distance of r from a center of the function dielectric sheet layer; $n_{min}$ represents a minimum refractive index of the function dielectric sheet layer; and c represents a number of the first plurality of impedance matching layers.

2. The impedance matching component of claim 1, further comprising a second plurality of impedance matching layers attached to the second side surface of the function dielectric sheet and distributed symmetrically with the first plurality of impedance matching layers, and a refractive index distribution of each of the second plurality of impedance matching layers is identical to that of a corresponding one of the first plurality of impedance matching layers that is disposed symmetrically therewith.

3. The impedance matching component of claim 1, wherein the function dielectric sheet layer comprises a plurality of metamaterial sheet layers, each of which comprises a sheet-like substrate and a plurality of man-made microstructures attached on the substrate.

4. The impedance matching component of claim 1, wherein each of the first plurality of impedance matching layers comprises a sheet-like substrate and a plurality of man-made microstructures attached on the substrate.

5. The impedance matching component of claim 3, wherein each of the man-made microstructures is a two-dimensional (2D) or three-dimensional (3D) structure comprising at least one metal wire.

6. The impedance matching component of claim 3, wherein the function dielectric sheet layer is adapted to converge electromagnetic waves; the metamaterial sheet layers have an identical refractive index distribution to each other, each of the metamaterial sheet layers comprises a circular region and a plurality of annular regions concentric with the circular region, refractive indices of the circular region and the annular regions decrease continuously from np to no as a radius thereof increases, and points having a same radius have a same refractive index.

7. The panel of claim 1, wherein the panel is a metamaterial panel.

8. The metamaterial panel of claim 7, wherein the impedance matching component further comprises a second plurality of impedance matching layers attached to the second side surface of the function dielectric sheet layer and distributed symmetrically with the first plurality of impedance matching layers, and a refractive index distribution of each of the second plurality of impedance matching layers is identical to that of a corresponding one of the first plurality of impedance matching layers that is disposed symmetrically therewith.

9. The metamaterial panel of claim 7, wherein the function dielectric sheet layer comprises a plurality of metamaterial sheet layers, each of which comprises a sheet-like substrate and a plurality of man-made microstructures disposed on the substrate; and/or each of the first plurality of impedance matching layers comprises a sheet-like substrate and a plurality of man-made microstructures attached on the substrate.

10. An antenna comprising a radiating source and the panel of claim 1, wherein the panel is a metamaterial panel.

11. A converging component, comprising a function dielectric sheet layer and an impedance matching component layer, wherein the impedance matching component layer is disposed on and adjacently attached to a first side surface of the function dielectric sheet layer, and the impedance matching component layer comprises a first plurality of impedance matching layers, each of which has a refractive index distribution represented as follows:

$$n_i(r) = n_{min} \times \left(\frac{n_g(r)}{n_{min}}\right)^{\frac{i}{c+1}};$$

where, i represents a serial number of each of the first plurality of impedance matching layers and is a positive integer, and the serial number increases as it gets closer to the function dielectric sheet; $n_i(r)$ represents refractive indices of points in an ith impedance matching layer of the first plurality of impedance matching layers that have a distance of r from a center of the ith impedance matching layer; $n_g(r)$ represents refractive indices of points in the function dielectric sheet that have a distance of r from a center of the function dielectric sheet; $n_{min}$ represents a minimum refractive index of the function dielectric sheet; and c represents a number of the first plurality of impedance matching layers;

the function dielectric sheet having a thickness between the first side surface and a second side surface, configured such that the first and second side surfaces are parallel to each other such that waves enter the first side surface and exit second side surface after propagating through a lens, wherein an electromagnetic wave diverging in the form of a spherical wave is emitted from a radiation source and incident on the first side surface, divided into a plurality of concentric annular bodies that each have a curved side surface, a bottom surface, and a to surface; wherein the annular bodies are adjacently attached to each other by their curved sides, and each bottom surface has a radius smaller than that of its corresponding top surface, and the top surfaces form the second side surface;

each concentric annular body having a set of first straight lines connecting the radiation source to a corresponding set of points on a circular boundary line of the bottom surface, and a second straight line perpendicular to the function dielectric sheet layer, wherein each first straight line forms an angle θ with the second straight line, wherein the same angle θ corresponds to each of the points in the set of points; additional sets of first straight lines connecting the radiation source to additional corresponding sets of points along the curved side surface, wherein each additional set of points on the curved surface form a circular line and has a same uniquely corresponding angle θ and a same refractive index; each curved side surface is formed by rotating a generatrix which extends along a direction of the thickness about the second straight line; and refractive indices of each of the concentric annular bodies decrease gradually as the angle θ increases.

12. The converging component of claim 11, wherein the impedance matching component further comprises a second plurality of impedance matching layers attached to the second side surface of the function dielectric sheet and distributed symmetrically with the first plurality of impedance matching layers, and a refractive index distribution of each of the second plurality of impedance matching layers is identical to that of a corresponding one of the first plurality of impedance matching layers that is disposed symmetrically therewith.

13. The converging component of claim 11, wherein each of the impedance matching layers comprises a sheet-like substrate and a plurality of man-made microstructures attached on the substrate.

14. The converging component of claim 11, wherein each of the first straight lines of the first set of straight lines connecting the radiating source to the points on the circular boundary line which is an outer circumference of the bottom surface of the $i^{th}$ annular body and the second straight line form an angle $\theta_i$ therebetween, i is a positive integer, and i decreases as each of the additional sets of points get closer to the center of the function dielectric sheet layer; and the angle $\theta_i$ satisfies following formula:

$$\sin c(\theta_i) = \frac{d}{\lambda}(n_{max(i+1)} - n_{min(i)});$$

-continued $$s\times\left(\frac{1}{\cos\theta_i}-\frac{1}{\cos\theta_{i-1}}\right)=\frac{d}{\sin c(\theta_{i-1})}n_{max(i)}-\frac{d}{\sin c(\theta_i)}n_{min(i)}\Big);$$

where, $$\sin c(\theta_i)=\frac{\sin(\theta_i)}{\theta_i},$$

$$\sin c(\theta_{i-1})=\frac{\sin(\theta_{i-1})}{\theta_{i-1}},$$

$$\theta_0=0;$$

s is distance from the radiating source to the function dielectric sheet; d is thickness of the function dielectric sheet layer; λ is wavelength of the electromagnetic wave; $n_{max(i)}$, $n_{min(i)}$ are a maximum refractive index and a minimum refractive index of the $i^{th}$ annular body; and $n_{max(i+1)}$, $n_{min(i+1)}$ are a maximum refractive index and a minimum refractive index of the $i+1^{th}$ annular body.

15. The converging component of claim 14, wherein maximum refractive indices and minimum refractive indices of any two adjacent ones of the annular bodies satisfy:

$$n_{max(i)}-n_{min(i)}=n_{max(i+1)}-n_{min(i+1)}.$$

16. The converging component of claim 15, wherein maximum refractive indices and minimum refractive indices of any three adjacent ones of the annular bodies satisfy:

$$n_{max(i+1)}-n_{min(i)}>n_{max(i+2)}-n_{min(i+1)}.$$

17. The converging component of claim 14, wherein refractive indices of the $i^{th}$ annular body satisfy $$n_i(\theta)=\frac{\sin\theta}{d\times\theta}\left(n_{max(i)}\times d+s-\frac{s}{\cos\theta}\right).$$

18. The converging component of claim 14, wherein a generatrix of an outer surface of the $i^{th}$ annular body is a circular arc segment, an intersection point between a perpendicular line, which is perpendicular to a line connecting the radiating source to a point on the outer circumference of the bottom surface of the $i^{th}$ annular body, and a surface of the function dielectric sheet that faces away from the radiating source is a circle center of the circular arc segment, and a perpendicular line segment between the intersection point and a point on the outer circumference of the bottom surface of the $i^{th}$ annular body is a radius of the circular arc segment.

19. The converging component of claim 14, wherein a generatrix of an inner surface of the $i^{th}$ annular body is a circular arc segment, an intersection point between a perpendicular line, which is perpendicular to a line connecting the radiating source to a point on an inner circumference of the bottom surface of the $i^{th}$ annular body, and a surface of the function dielectric sheet that faces away from the radiating source is a circle center of the circular arc segment, and a perpendicular line segment between the intersection point and a point on the outer circumference of the bottom surface of the $i^{th}$ region is a radius of the circular arc segment, where $i\geq 2$.

20. An antenna, comprising a converging component, wherein the converging component comprises a function dielectric sheet layer and an impedance matching component, the impedance matching component is disposed on and attached to the first side surface of the function dielectric sheet layer, and the impedance matching component comprises a first plurality of impedance matching layers, each of which has a refractive index distribution represented as follows:

$$n_i(r)=n_{min}\times\left(\frac{n_g(r)}{n_{min}}\right)^{\frac{i}{c+1}};$$

where, i represents a serial number of each of the first plurality of impedance matching layers and is a positive integer, and the serial number increases for each layer of the first plurality of impedance matching layers that gets closer to the function dielectric sheet layer; ni (r) represents refractive indices of points in a ith impedance matching layer of the first plurality of impedance matching layers that have a distance of r from a center of the ith impedance matching layer; ng (r) represents refractive indices of points in the function dielectric sheet layer that have a distance of r from a center of the function dielectric sheet layer; $n_{min}$ represents a minimum refractive index of the function dielectric sheet layer; and c represents a number of the first plurality of impedance matching layers;

the function dielectric sheet having a thickness between the first side surface and a second side surface, configured such that the first and second side surfaces are parallel to each other such that waves enter the first side surface and exit second side surface after propagating through a lens, wherein an electromagnetic wave diverging in the form of a spherical wave is emitted from a radiation source and incident on the first side surface, divided into a plurality of concentric annular bodies that each have a curved side surface, a bottom surface, and a to surface; wherein the annular bodies are adjacently attached to each other by their curved sides; and each bottom surface has a radius smaller than that of its corresponding top surface, and the top surfaces form the second side surface;

each concentric annular body having a set of first straight lines connecting the radiation source to a corresponding set of points on a circular boundary line of the bottom surface, and a second straight line perpendicular to the function dielectric sheet layer, wherein each first straight line forms an angle θ with the second straight line, wherein the same angle θ corresponds to each of the points in the set of points; additional sets of first straight lines connecting the radiation source to additional corresponding sets of points along the curved side surface, wherein each additional set of points on the curved surface form a circular line and has a same uniquely corresponding angle θ and a same refractive index; each curved side surface is formed by rotating a generatrix which extends along a direction of the thickness about the second straight line; and refractive indices of each of the concentric annular bodies decrease gradually as the angle θ increases.

* * * * *